US009710997B2

(12) United States Patent
Schrementi et al.

(10) Patent No.: US 9,710,997 B2
(45) Date of Patent: Jul. 18, 2017

(54) SYSTEM AND METHOD FOR SYNCHRONIZING INDICATORS ASSOCIATED WITH A PLURALITY OF GAMING MACHINES

(71) Applicant: Incredible Technologies, Inc., Vernon Hills, IL (US)

(72) Inventors: Daniel J. Schrementi, Lombard, IL (US); Richard Ditton, Kildeer, IL (US); Scott J. Schoenberg, Highland Park, IL (US); Daniel John Whelan, Schaumburg, IL (US)

(73) Assignee: INCREDIBLE TECHNOLOGIES, INC., Vernon Hills, IL (US)

( * ) Notice: Subject to any disclaimer, the term of this patent is extended or adjusted under 35 U.S.C. 154(b) by 190 days.

(21) Appl. No.: 14/252,350

(22) Filed: Apr. 14, 2014

(65) Prior Publication Data

US 2014/0309029 A1 Oct. 16, 2014

Related U.S. Application Data

(60) Provisional application No. 61/838,112, filed on Jun. 21, 2013, provisional application No. 61/812,104, filed on Apr. 15, 2013.

(51) Int. Cl.
*G07F 17/32* (2006.01)
*H05B 37/02* (2006.01)

(52) U.S. Cl.
CPC ..... *G07F 17/3211* (2013.01); *G07F 17/3223* (2013.01); *H05B 37/0245* (2013.01)

(58) Field of Classification Search
CPC ..... G07F 17/3206; G07F 17/3211; G07F 17/3213; G07F 17/3227; G07F 17/3223; G07F 17/3244
See application file for complete search history.

(56) References Cited

U.S. PATENT DOCUMENTS 8,821,244 B1 * 9/2014 Detlefsen ..... G07F 17/323 463/16
2006/0154723 A1 * 7/2006 Saffari ..... G07F 17/32 463/29
2009/0138133 A1 * 5/2009 Buchholz ..... G07F 17/3202 700/295

(Continued)

*Primary Examiner* — James S McClellan
*Assistant Examiner* — Kevin Carter
(74) *Attorney, Agent, or Firm* — Husch Blackwell LLP; George S. Pavlik

(57) ABSTRACT

A system and method for synchronizing indicators of electronic gaming machines. The system providing a plurality of electronic gaming machines each having a control array and at least one electronic display operatively connected thereto, at least one lighting device operatively connected to the plurality of gaming machines and control circuitry, including a programmable processor, operatively connected to the lighting device. The lighting device having elements to present synchronized lighting effects at the plurality of gaming machines, the synchronized lighting effects including an attract mode and an emotive mode. The system registering a condition on at least one gaming machine and electrically transmitting a signal to the lighting device. The lighting device initiating a predetermined lighting effect at the plurality of machines in response to the registered condition.

23 Claims, 4 Drawing Sheets

(56) References Cited

U.S. PATENT DOCUMENTS

| | | | | |
|---|---|---|---|---|
| 2011/0070948 | A1* | 3/2011 | Bainbridge | G07F 17/3218 463/30 |
| 2011/0118034 | A1* | 5/2011 | Jaffe | G07F 17/3211 463/42 |
| 2011/0201411 | A1* | 8/2011 | Lesley | G07F 17/32 463/25 |
| 2012/0129601 | A1* | 5/2012 | Gronkowski | G07F 17/3211 463/31 |
| 2012/0178528 | A1* | 7/2012 | Brunell | G07F 17/3216 463/31 |
| 2014/0057716 | A1* | 2/2014 | Massing | A63F 13/00 463/31 |
| 2014/0100030 | A1* | 4/2014 | Burke | G07F 17/3204 463/31 |
| 2014/0206432 | A1* | 7/2014 | Radek | G07F 17/3223 463/25 |

* cited by examiner

SYSTEM AND METHOD FOR SYNCHRONIZING INDICATORS ASSOCIATED WITH A PLURALITY OF GAMING MACHINES

CROSS REFERENCE TO RELATED APPLICATION

This application claims the benefit of both U.S. Provisional Patent Application Ser. No. 61/812,104 filed Apr. 15, 2013 and U.S. Provisional Patent Application Ser. No. 61/838,112 filed Jun. 21, 2013, the entirety of these applications are hereby incorporated by reference as if fully set forth herein.

FIELD

The subject invention pertains generally to a system and method of synchronizing lights or other indicators in a plurality of gaming machines, and more particularly a system and method providing coordinated lighting effects based upon detected activity at an individual machine.

BACKGROUND

Electronic gaming machines ("EGMs") are generally well known and have been relatively popular, and profitable, for a number of years. Examples of such machines include for example, video slot machines, video poker machines, bar-top gaming devices, and coin-operated amusement devices. Typically, EGMs are arranged at gaming venues in banks consisting of at least two EGMs that are physically located adjacent or proximate to one another. Usually, EGMs in a bank will be the same style or type, and/or be made by the same manufacturer. EGMs in a bank can also be networked or otherwise operably or electronically linked for communications purposes.

Some types of EGMs, and/or banks of EGMs, are known to have indicators, lights or luminescent devices, independent of their video monitors or electronic game displays, which can flash, blink, and flow in predetermined patterns. Such lights can be incorporated directly as part of the EGM, can be part of a unit that can be affixed to an EGM, or can be on a separate unit in close proximity to one or more of the EGMs. For example, certain types of EGMs can have an electroluminescent "topper" which can be physically mounted to an EGM, such as for instance, to the top portion of the EGM above the display or body of the machine so that they can be easily seen at a distance across a gaming venue. A bank of EGMs can also feature "bank signs" having one or more light fixtures. Such bank signs can be placed, for instance, above a bank of two or more EGMs in order to promote play of all the machines in the bank. Such bank signs can be mechanically or electrically coupled to one or more EGMs or be independently powered.

It is generally known in the art to synchronize lights in a bank of EGMs so that they illuminate in patterns suggesting that they are "flowing" from one EGM to another, or so that they illuminate in synchronization or in sequence. These light sequences, whether on individual EGMs, or in banks, can also be used for distinctive "attract mode" patterns which attempt to draw the eye of potential players. Such known synchronization techniques, however, do not take into account the status or activity of individual EGMs within the bank and further do not coordinate lighting effects among a plurality of EGMs based upon activity at individual EGMs within a bank. Thus, such limitations are generally not as effective in drawing players to vacant or inactive gaming machines and can further cause players at individual machines to become distracted or annoyed with intense or lurid lighting effects at adjacent machines. As a result, players may have a more difficult time finding a vacant machine or may be more inclined to stop playing a machine due to distraction or overstimulation. This can lead to certain gaming machines being inactive for extended periods of time. As such machines are typically income producing, extended periods of inactivity can result in a loss of revenue for the gaming establishment. Thus, game developers and owners/operators are continually in need of new techniques for attracting interested players and maintaining player satisfaction.

In view of the foregoing, it would be useful, and thus there is a need, for a system and method that can coordinate lighting effects among a plurality of EGMs in response to detected conditions or activity at an individual EGM within a bank. It would be further desirable for such systems and methods to have multiple lighting modes which can be initiated depending on a detected condition or activity at an individual EGM. It will be recognized by persons of ordinary skill in the art that such techniques can be more effective in drawing players to inactive machines and can further maintain player satisfaction by not providing distraction or irritation.

DETAILED DESCRIPTION

Figure 1A:
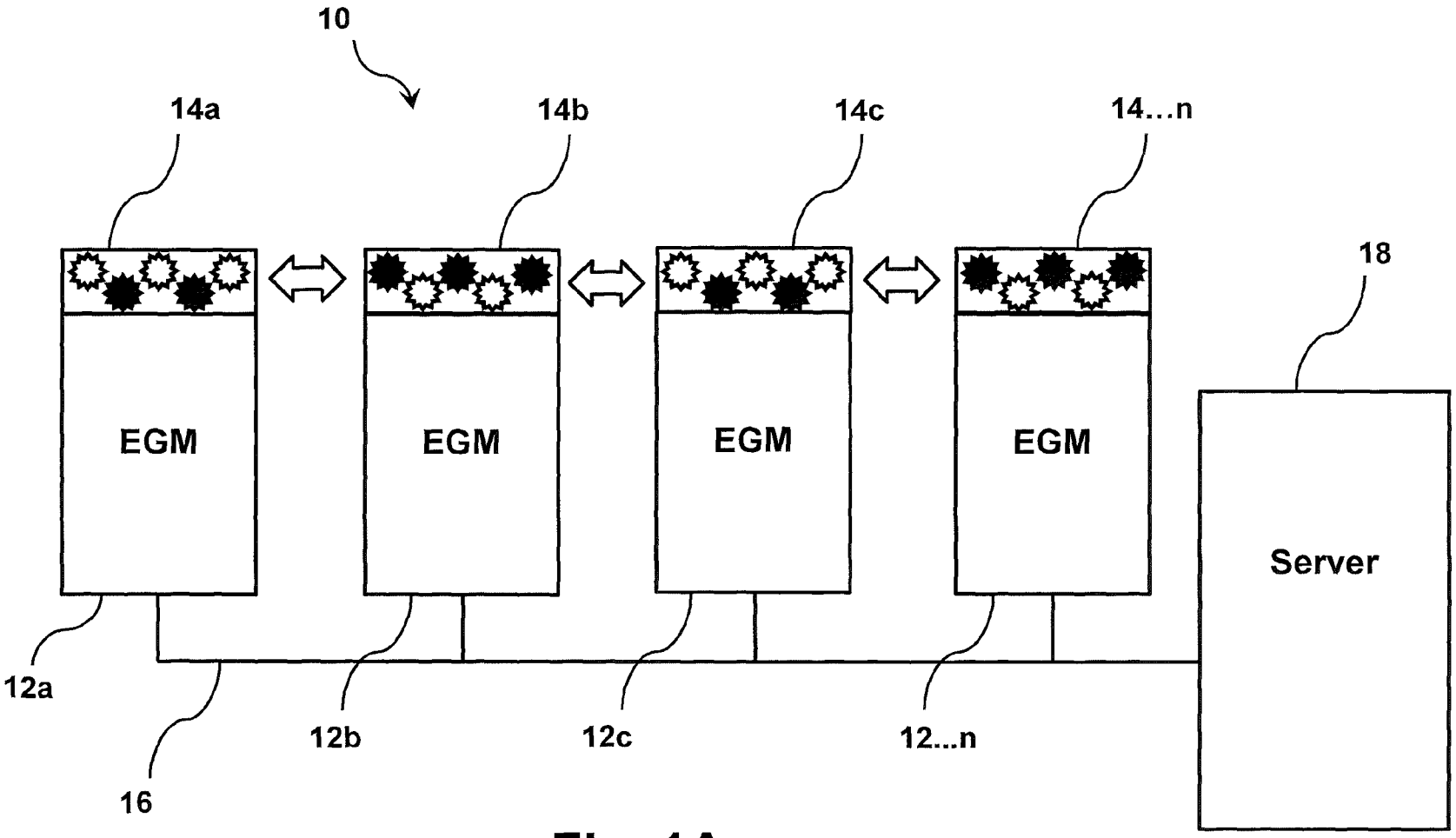
FIG. 1A is a block diagram illustrating a first representational view of a system in accordance herewith.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

As described herein, embodiments of the subject invention are directed to a system and method for synchronizing or coordinating lights or other indicators in a plurality of gaming machines. Such embodiments provide for EGMs in a bank to be alerted as to whether one of the EGMs in the bank is actively being played by a player. Where none of the EGMs in the bank are in use, the lights associated with the EGMs can begin a "synchronized attract mode." In this mode, the lights in the bank can gradually (or all at once after a predetermined lapse of time following the last "pull" on any machine in the bank, or when no machine has a current credit balance, or both) begin an aggressive lighting pattern where the lights flash brighter or with more intensity, at a more rapid pace or sequence and/or in more elaborate or complex patterns intended to draw attention to the entire bank of EGMs as well as to each EGM, individually.

Embodiments disclosed herein can also provide for alerting an individual EGM in a bank as to the initiation of play (or other activity) at an alternate EGM in the bank in order to modify the synchronized attract mode. For example, when a player engages one of the EGMs in the bank, the lights associated with the other EGMs can remain in attract mode, but switch to a less aggressive "emotive" style of lighting characterized by less bright or slower lighting effects that are intended to avoid distraction or irritation to a player that is actively playing one of the EGMs. This practice could include either the lights of the entire bank of EGMs switching to emotive mode, or only switching selected lights which are the closest in proximity to the currently active EGM. Although known techniques can provide an emotive style of lighting for lights associated with a single EGM that is in use, embodiments disclosed herein provide for a novel system that can coordinate lighting effects across a plurality of EGMs in response to activity at one of the EGMs. Thus, such systems provide for changing lighting effects at a nearby EGM that is not in use, in response to use at another machine.

It will be recognized by persons of ordinary skill in the art that such functions can draw interested players to available or inactive machines and can further keep players at a machine for a longer period of time, thus increasing the potential revenue to the owner/operator of the gaming device. It will be further recognized that embodiments disclosed herein can provide for a more entertaining and enjoyable gaming experience to players by controlling lighting effects of a game.

According to embodiments presented herein, any kind of known lighting device or other kind of sensory output device can be coordinated or synchronized to create the desired lighting effect or mode. Such lighting devices can include, for example, light emitting diodes ("LEDs"), incandescent lamps, cold cathodes, lasers, fluorescent, halogen or neon lamps or tubes or any other type of illumination device. In addition, embodiments presented herein can further coordinate lighting effects produced by electronic display devices, such as for example LCD, LED, plasma or CRT monitors or backlit lighting devices having static images that are illuminated from behind by one or more light sources.

The lighting devices can be part of, or affixed directly to, the individual EGMs or plurality of the EGMs, or can be separate units that are physically detached from the EGMs in a proximate or nearby area. For example, embodiments disclosed herein can coordinate the lighting effects of electroluminescent "toppers" which can be physically mounted to an EGM, such as for instance, to the top portion of the EGM above the display or body of the machine so that they can be easily seen at a distance across a gaming venue. The coordination of lighting effects as described herein can additionally be carried out in connection with "bank signs" having one or more light fixtures. Such bank signs can be placed, for instance, above a bank of two or more EGMs in order to promote play of all the machines on the bank. Such bank signs can be mechanically or electrically coupled to one or more EGMs or be independently powered.

The lighting devices can be electrically coupled to an EGM in order to draw power directly from the machine through a power/control interface. According to such configurations, the lights can also be controlled through the EGM's main programming interface, or through a program executed by an alternate electrical device, such as for example a common server, operatively connected to the EGM or lighting device.

Figure 1B:
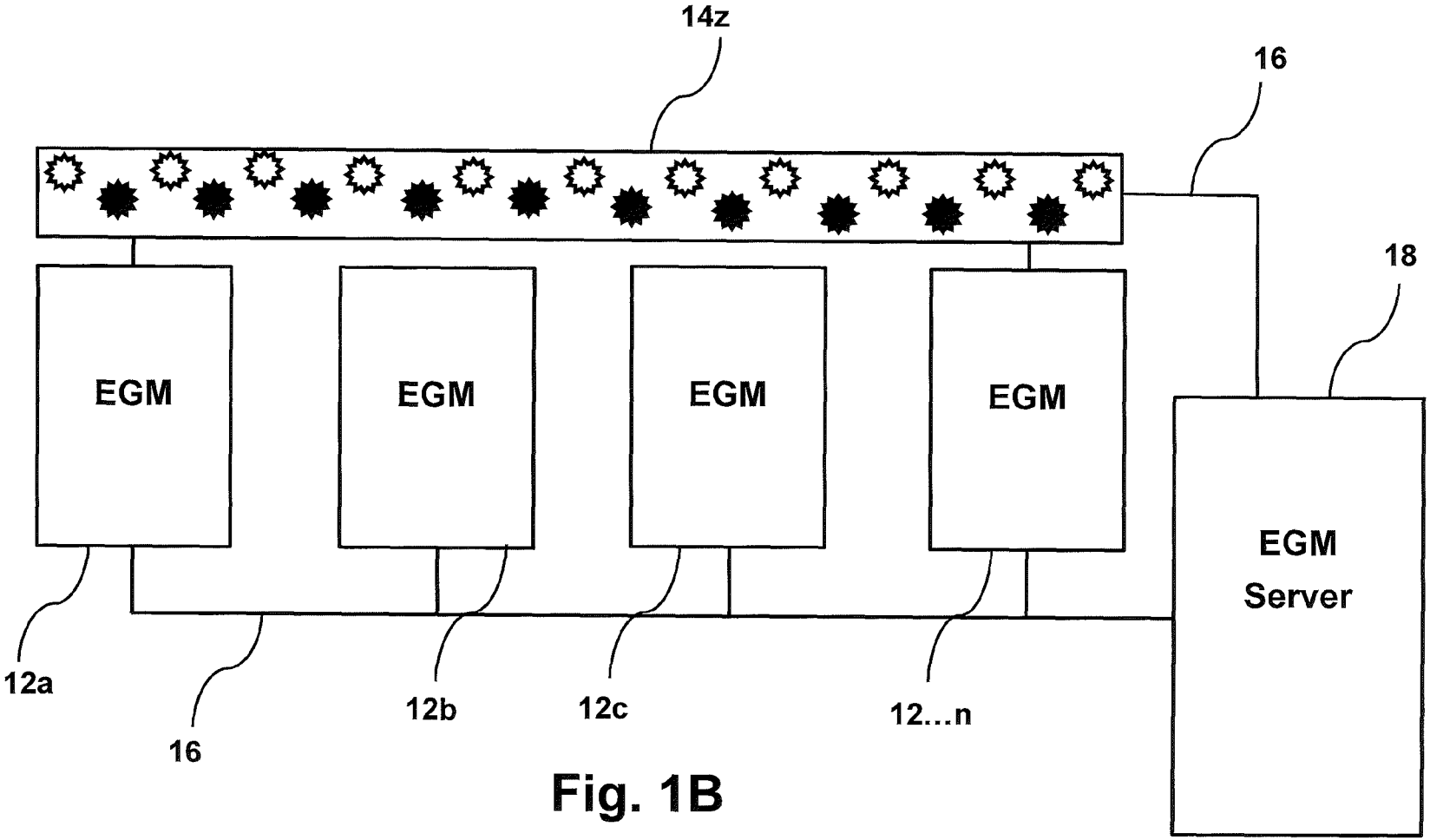
FIG. 1B is a block diagram illustrating a second representational view of a system in accordance herewith.

With reference now to the figures, FIGS. 1A and 1B illustrate representational views of a system 10 according to embodiments of the subject invention. The system 10 can comprise a plurality of EGMs 12*a* . . . 12*n* and one or more lighting devices 14*a* . . . 14*n* operatively connected to the EGMs 12*a* . . . 12*n*. As illustrated in FIG. 1A, each EGM 12*a* . . . 12*n* can include, and/or be individually connected to, a separate lighting device 14*a* . . . 14*n*, such as for example lights affixed directly to the machine's housing or an electroluminescent topper mounted to the top of the machine. Additionally, or alternatively, the plurality of EGMs 12*a* . . . 12*n* can, as shown in FIG. 2B, be operatively connected to a common lighting device 14*z*, such as for example a bank sign or electronic display. The lighting devices 14*a* . . . 14*n*, 14*z* can incorporate any kind of lighting element as previously identified and described, or can contain multiple different kinds of lighting elements.

The EGMs 12*a* . . . 12*n* can be physically arranged in a single bank or in close proximity to one another and can have identical or related features, themes or games, or can be entirely different or otherwise unrelated. The EGMs 12*a* . . . 12*n*, 12*z* can be operatively connected to one another via wired or wireless connection 16 and can be further electronically connected to a common server 18 physically located in or around the bank of EGMs 12*a* . . . 12*n*, or elsewhere in a remote location.

The server 18 can receive electronic signals from the EGMs 12*a* . . . 12*n* as to game activities or conditions being performed thereon and can contain a programmable processor, circuitry and control programs stored on a computer readable medium for identifying and recording such conditions or activities. Such control programs and circuitry can contain stored data that can associate predetermined conditions or activities being carried out on an EGM 12*a* . . . 12*n* with predetermined lighting effects or modes. Thus, where a certain condition is detected, the server can transmit signals to the lighting devices 14*a* . . . 14*n*, 14*z* to control or adjust the lighting elements in the predetermined manner.

For example, where the lighting devices 14*a* . . . 14*n*, 14*z* are in a synchronized "attract mode" and a player starts playing a game on one of the gaming machines (e.g. 12*a*), the EGM 12*a* can send a signal to the common processor 18 that EGM 12*a* is active. The server 18 can in turn send a signal to lighting devices 14*a* . . . 14*n*, 14*z*, to adjust, modify or terminate the attract mode lighting effects. In adjusting such lighting effects, the lighting devices 14*a* . . . 14*n*, 14*z* (or portions thereof) can be directed by the server 18 to commence a less intense, emotive lighting mode, where, for example, the lighting elements flash with less intensity or frequency. In performing such synchronization, the lighting device 14*a* associated with the active EGM 12*a* can be adjusted in the same manner as the remaining lighting devices 14*b* . . . 14*n*, 14*z*, or can be adjusted in a different manner, such as for example, being turned off completely or being adjusted to present an "active" mode. In addition, where the system 10 incorporates a common lighting device 14*a*, as illustrated in FIG. 1B, different portions, sections or lighting elements of the device 14*a* can be adjusted depending on their proximity to an active EGM 12*a*. Thus, in synchronizing the lighting devices 14*a* . . . 14*n*, 14*z* in such a manner, the system 10 can control lighting effects so as not to distract or irritate the player that is actively playing one of the EGMs 12*a*.

Although the embodiments illustrated in FIGS. 1A and 1B are shown to include a common server 18, persons of ordinary skill in the art will recognize that a server 18 is not required and that system 10 can synchronize and coordinate the lighting effects with control programs and circuitry provided by the individual EGMs 12*a* . . . 12*n* or on some other kind of electronic device, such as for example, a computer, electronic tablet, smartphone or PDA operatively connected to, or in electronic communication with, the system 10. Where the lighting devices 14*a* . . . 14*n*, 14*z* are controlled by the individual EGMs 12*a* . . . 12*n*, the EGMs 12*a* . . . 12*n* can control the synchronization of the lighting effects by transmitting signals directly to the lighting devices 14*a* . . . 14*n*, 14*z* or the other EGMs 12*a* . . . 12*n* as need be.

Figure 2:
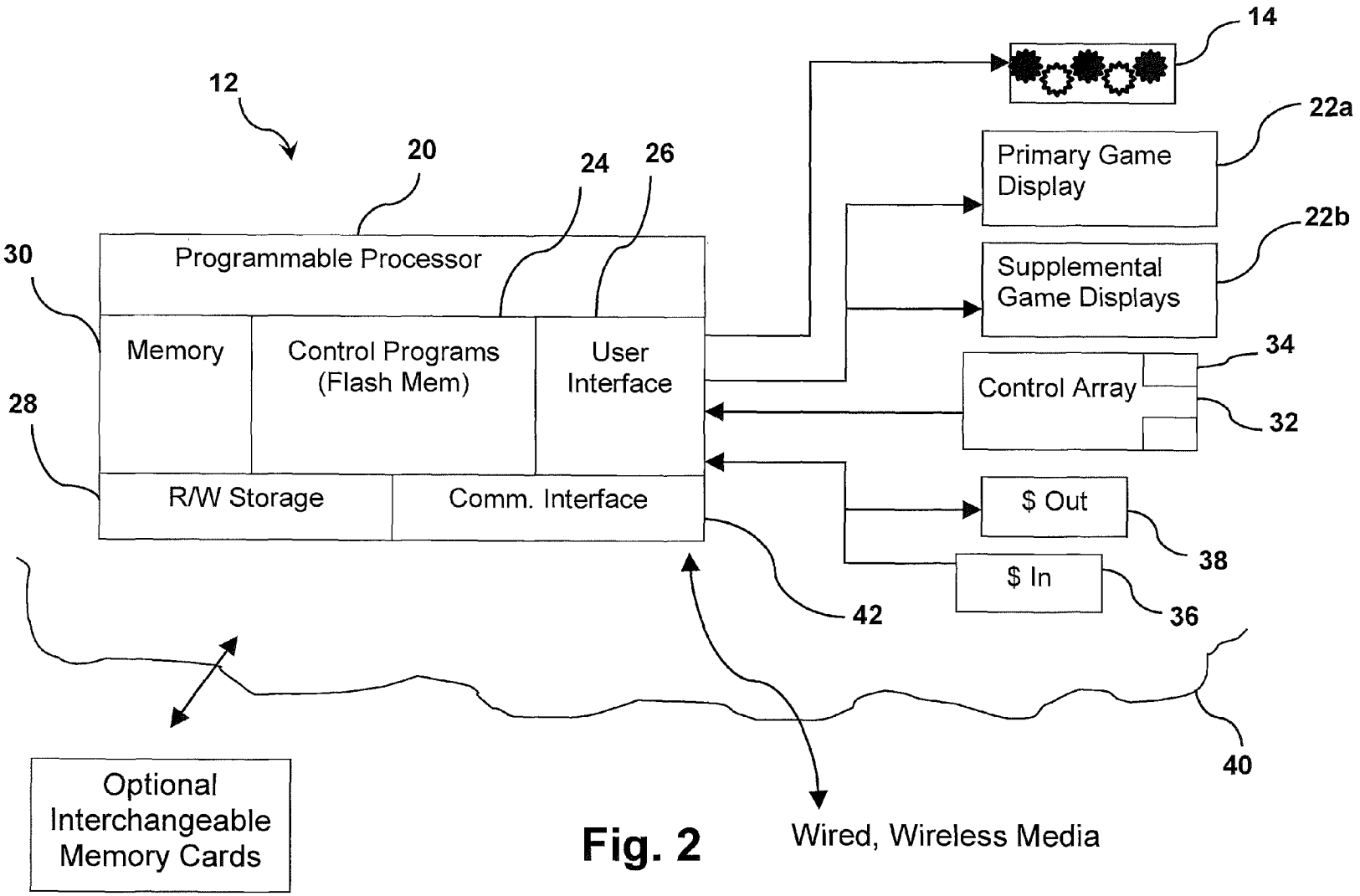
FIG. 2 is a block diagram illustrating an electronic gaming machine in accordance herewith.

FIG. 2 illustrates an EGM 12 according to embodiments of the subject invention. The EGM 10 can include a programmable processor 20 (such as for example a microprocessor or microcontroller) operatively coupled to one or more game displays 22*a*, 22*b*. The processor 20 can include control programs 24 and associated circuitry and be operatively connected to a user interface 26 with input/output circuits and at least one storage unit 28 which can store a plurality of instructions executable by the processor 20. The processor 20 can also include memory 30 which can include a main memory containing dynamic information processed by the processor 20 during operation, and/or a static memory which contains fixed information, such as, for example, an operating system, game programs, and a configuration of information necessary for the processor 20 to register and execute input from a player through ,a control array 32.

The displays 22*a*, 22*b* can include any kind of electronic display device suitable for visually presenting dynamic video images or representations of a game played on the EGM 12. The displays 22*a*, 22*b* can be CRT, LCD, plasma or LED display devices or monitors and can be part of the EGM 12 by being enclosed in the same housing or cabinet 40 as the processor 20, or can be a separate unit either affixed to EGM 12 or physically detached from the EGM 12. The displays 22*a*, 22*b* can additionally include touch screen capabilities for receiving input from a player.

The processor 20 can execute the control programs 24 to perform primary functions for play the game, such as for example, randomly selecting game outcomes from a plurality of possible outcomes, recognizing a particular outcome as a predetermined winning or non-winning outcome and/or determining a reward amount associated with a particular winning outcome. The processor 20 can additionally control the game displays 22*a*, 22*b* by generating static or dynamic video for presentation thereon. The processor 20 and control programs 24 can additionally include applications for recording and/or registering game activity, or inactivity, which can be used to control the lighting devices 14*a* . . . 14*n*, 14*z*. Such activity or inactivity can be detected from the start or completion of a game program played on the EGM 12, by the deposit of wagers into an EGM 12, by physically detecting the presence of an individual in close proximity to the EGM 12, or by any other event or condition.

The control array 32 can include one or more input devices, such as for example, a keyboard, mechanical lever, a touch-screen, push buttons or pads and/or any other means for control, or desired combination of controls, able to accept input from a player and produce output to the game display 22*a*, 22*b* in response to a player's input. The EGM 12 or control array 32 can additionally include one or more sensors 34 for detecting motion or the presence of an individual at or around the EGM 12. Such sensors can include, for example photoelectric sensors, temperature sensors, infrared sensors, ultrasonic sensors, microwave sensors and/or any other type of device used for optical or acoustical detection. The sensors can be operatively coupled to the processor 20 which can register detection and associate such detection with predetermined lighting effects. Such predetermined lighting effects can be electronically stored as programmed data on a computer readable medium or can be generated through artificial intelligence ("AI") systems incorporated by the EGM 12 or system 10 which can register activities and results against a ranking of possible results and generate lighting effects which have been identified as being associated increased or continuous play of the machines.

Where embodiments of the subject invention are practiced or provided in connection with a wagering game, the gaming machine 12 can further include a credit input device 36, such as for example a coin or bill acceptor or card reader and a payoff device 38. The credit input device and payoff device can be operatively connected to the processor 20 and when money or other credits are deposited in connection with a game, the control program 24 can instruct the payoff device to issue an award in response to the selection of certain predetermined winning outcomes of the game. The reward or payoff can be provided in any form, including for example, coins, bills, credits, points, cards, tickets or coupons.

The EGM 12 can feature or be operatively connected to one or more lighting devices 14, which, as previously described, can be affixed to or otherwise be in close proximity to the EGM 12, such as for example, lamps, lights or other luminescent devices mounted to the top or side of the exterior housing or cabinet 40 of the EGM 12. Such lighting devices 14 can include LEDs, incandescent lamps, cold cathodes, lasers, fluorescent, halogen or neon lamps or tubes or any other type of illumination elements.

The storage unit 20 or memory 22 can contain stored data or analytics providing for certain lighting conditions or effects, such as for example certain attract modes or emotive style lighting modes as previously described. Thus, where a predetermined activity or period of inactivity is detected, the processor 20 can transmit instructions for controlling the lighting devices 14 to implement the corresponding lighting effect.

The gaming machine 12 can additionally feature communication means for electrically transmitting signals, including control signals, game data or detected conditions to a remote electronic device such as the common server 18 or lighting devices 14*a* . . . 14*n*, 14*z* as illustrated in FIGS. 1A or 1B, or any external device, such as for example, a computer, network or display device, dedicated storage device, or other mobile electronic device such as a PDA, smart phone, notebook computer or electronic tablet. Such communication means can include a communication interface 42 that can connect the EGM to external electronic devices via wired or wireless communication.

Figure 3:
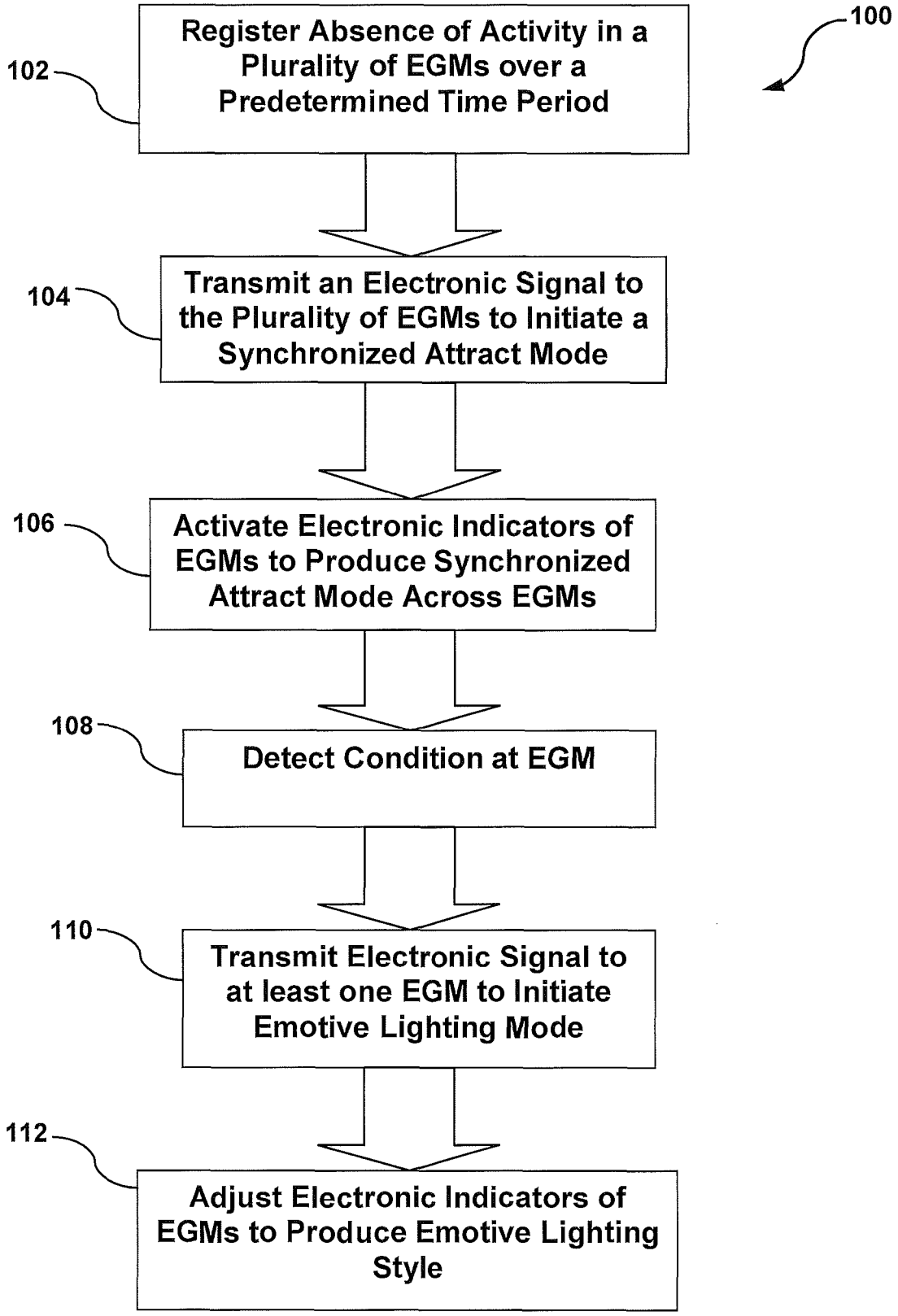
FIG. 3 is a flowchart illustrating a method according to embodiments described herein.

FIG. 3 is a block diagram illustrating a method 100 according to embodiments described herein. According to such method 100, an absence of activity at a plurality of EGMs can be registered 102 over a predetermined period of time and an electronic control signal can be transmitted 104 to lighting devices associated with the inactive EGMs. The signal can control 106 the lighting devices to commence a synchronized attract mode where the lighting elements or indicators are illuminated with more intensity or flash at a more rapid pace. As described previously, such attract mode can be generated across lighting devices associated with a plurality of inactive EGMs and can include distinctive patterns and/or progressions which can draw attention to the inactive EGMs.

At any time, activity can be detected 108 at one or more of the EGMs and a control signal can be electronically transmitted 110 to the lighting devices to adjust the lighting effect. For example, the lighting devices can be adjusted 112 to produce a coordinated or synchronized emotive style lighting effect where lighting devices at or proximate an active EGM are dimmed, deactivated or slowed. As described previously, the detected activity can be any the initiation of a game or game program, the deposit of a wager, movement at or around an EGM or any additional event or condition capable of being performed, input or detected by the EGM.

As will be understood by those of ordinary skill in the art, while the description above details the preferred and best mode(s) of practicing the invention, many other configurations and variations are possible. For example, the invention need not be practiced with a commercial/regulated gaming system, but could be used with a variety of coin-operated amusement devices, home gaming systems, or any other appropriate system. Accordingly, the scope of the invention should be determined not by the embodiment(s) illustrated, but by the claims below and their equivalents.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A system comprising:

a plurality of electronic gaming machines each having a control array and at least one electronic display operatively connected thereto;

at least one lighting device operatively connected to each of the plurality of electronic gaming machines, the at least one lighting device having lighting elements to present a default lighting condition producing individual lighting effects at its associated electronic gaming machine and synchronized lighting effects across the plurality of electronic gaming machines;

control circuitry, including a programmable processor operatively connected to the at least one lighting device, game inactivity for a predetermined period of time across the plurality of electronic gaming machines and an initiation of game activity at one or more of the plurality of gaming machines being registered by the control circuitry, a signal being transmitted from the control circuity to the at least one lighting device in response to registered game inactivity for the predetermined period of time and in response to registered initiation of game activity;

the synchronized lighting effects at the plurality of electronic gaming machines being initiated from the default lighting condition in response to the registered game inactivity across the plurality of electronic gaming machines, a coordinated attract mode being initiated across the plurality of gaming machines in response thereto, the coordinated attract mode featuring enhanced lighting effects over the default lighting condition, the enhanced lighting effects of the attract mode being substantially the same at each gaming machine of the plurality of gaming machines; and the synchronized lighting effects across the plurality of gaming machines being modified in response to the initiation of game activity being registered at one or more gaming machines with the attract mode lighting effects being terminated and an emotive mode being initiated on at least some of the plurality of gaming machines in response to the initiation of game activity being registered at one or more of the plurality of game machines, the emotive mode having reduced lighting effects from the attract mode.

2. The system of claim 1 where the programmable processor is located on a common server operatively connected to the plurality of electronic gaming machines.

3. The system of claim 1 having a plurality of lighting devices operatively connected to at least some of the plurality of electronic gaming machines.

4. The system of claim 1 where the attract mode includes at least one of a more rapid sequence of illumination or an increase in brightness of the lighting element over the default lighting condition.

5. The system of claim 1 where the emotive mode includes at least one of a deactivation or a reduction in brightness or illumination sequence of the lighting elements.

6. The system of claim 1 where the initiation of game activity includes at least one of activation of a game program, acceptance of a wager, physical detection of an individual, completion of a game program, actuation of a input device on the control array, or a predetermined time interval of inactivity at a gaming machine.

7. The system of claim 1 where the at least one lighting device includes at least one of a light emitting diode, incandescent lamp, cold cathode, laser or fluorescent, halogen or neon lamp or tube.

8. The system of claim 1 where lighting effects presented at an active machine differ from lighting effects presented at an inactive machine.

9. A method comprising:

registering inactivity at a plurality of electronic gaming machines over a predetermined period of time;

electrically transmitting a first signal to a plurality of lighting devices operatively connected to the plurality of electronic gaming machines, the first signal controlling the plurality of lighting devices to initiate a synchronized attract lighting mode across the plurality of electronic gaming machines, the synchronized attract lighting mode being substantially the same at each gaming machine of the plurality of gaming machines;

initiating the synchronized attract lighting mode at the plurality of lighting devices;

detecting the initiation of activity on at least one of the plurality of electronic gaming machines;

electrically transmitting a second signal to the plurality of lighting devices, the second signal instructing at least some lighting devices from the plurality of lighting devices to terminate the synchronized attract lighting mode and return to a default lighting condition and other lighting devices from the plurality of lighting devices to initiate an emotive lighting mode, the emotive mode having diminished lighting effects from the attract mode;

initiating the emotive lighting mode on the other lighting devices from the plurality of lighting devices.

10. The method of claim 9 where registering inactivity of the plurality of electronic gaming machines is performed by a central programmable processor operatively connected to the plurality of electronic gaming machines.

11. The method of claim 9 where detecting activity on at least one of the plurality of electronic gaming machines includes registering a start of new game on the at least one of the plurality of electronic gaming machines.

12. The method of claim 9 where detecting activity on at least one of the plurality of electronic gaming machines includes sensing movement proximate the at least one of the plurality of electronic gaming machines.

13. The method of claim 9 where initiating the attract lighting mode includes at least one of activating lighting elements, increasing the lighting elements brightness of illumination over a default lighting mode or illuminating lighting elements in a more rapid sequence over the default lighting mode.

14. The method of claim 9 where initiating the emotive lighting mode includes at least one of deactivating lighting elements, reducing the lighting element's brightness or illumination or illuminating the lighting elements in a slower sequence.

15. The method of claim 9 where transmitting a first and second signal is directed to a plurality of lighting devices and initiating the attract and emotive lighting modes is performed on a plurality of the at least one lighting device.

16. The method of claim 9 where initiating the emotive lighting mode is carried out by lighting devices connected or substantially adjacent to a gaming machine having detected activity.

17. A system for synchronizing light effects at a plurality of electronic gaming machines comprising:

a plurality of gaming machines having a programmable processor and control circuitry, a control array and at least one electronic display;

a plurality of lighting devices operatively connected to the plurality of electronic gaming machines, the plurality of lighting devices having lighting elements to present a default lighting condition producing independent lighting effects at individual electronic gaming machines of the plurality of electronic gaming machines and synchronized lighting effects across the plurality of electronic gaming machines, the synchronized lighting effects of the attract mode being substantially the same at each gaming machine of the plurality of gaming machines;

a central server operatively connected to the plurality of electronic gaming machines and plurality of lighting devices, the central server having control circuitry to register game inactivity for a predetermined period of time across the plurality of electronic gaming machines and an initiation of game activity at one or more of the plurality of gaming machines and to electrically transmit a signal to the plurality of lighting devices, the synchronized lighting effects at the plurality of electronic gaming machines being initiated from the default lighting condition in response to registered game inactivity across the plurality of electronic gaming machines with the attract mode being initiated across the plurality of gaming machines, and the synchronized lighting effects across the plurality of gaming machines being modified in response to the registered initiation of game activity at one or more gaming machines with the attract mode being terminated and an emotive mode being initiated on the lighting elements of at least one of the plurality of gaming machines in response to the initiation of game activity being registered at one or more of the plurality of game machines, the emotive mode including at least one of a deactivation of a reduction in brightness or illumination sequence of the lighting elements.

18. The system of claim 17 where the plurality of electronic gaming machines include circuitry to detect a condition at an individual machine and to transmit the detected condition to the central server.

19. The system of claim 17 where the registered game inactivity and game activity associated with a predetermined lighting effect programmed on a computer readable medium.

20. The system of claim 17 where the attract mode includes at least one of activation of a lighting element, more rapid sequence of illumination over a default lighting condition or an increase in brightness or intensity of a lighting element over the default lighting condition.

21. The system of claim 17 where the plurality of lighting devices includes at least one of a light emitting diode, incandescent lamp, cold cathode, laser or fluorescent, halogen or neon lamp or tube.

22. The system of claim 17 where the plurality of electronic gaming machines include sensors for detecting the registered condition.

23. The system of claim 17 where the registered initiation of game activity includes at least one of activation of a game program, acceptance of a wager, physical detection of an individual, completion of a game program, actuation of a input device on the control array, or a predetermined time interval of inactivity at a gaming machine.

* * * * *